US009017230B1

(12) United States Patent
Pitts

(10) Patent No.: US 9,017,230 B1
(45) Date of Patent: Apr. 28, 2015

(54) UPPER BODY STRENGTHENING SYSTEM

(71) Applicant: Desmond Charlton Pitts, Rockford, IL (US)

(72) Inventor: Desmond Charlton Pitts, Rockford, IL (US)

( * ) Notice: Subject to any disclaimer, the term of this patent is extended or adjusted under 35 U.S.C. 154(b) by 113 days.

(21) Appl. No.: 13/800,850

(22) Filed: Mar. 13, 2013

(51) Int. Cl.
*A63B 21/062* (2006.01)

(52) U.S. Cl.
CPC ..... *A63B 21/062* (2013.01)

(58) Field of Classification Search
CPC ..... A63B 21/062; A63B 2021/0623; A63B 23/02; A63B 21/00101; A63B 21/0012; A63B 21/00123; A63B 21/00127; A63B 21/1469; A63B 21/1488; A63B 21/1492; A63B 21/1496; A63B 2023/006; A63B 23/0238; A63B 23/1209; A63B 23/1245; A63B 23/1272
USPC ..... 482/92–94, 97–103
See application file for complete search history.

(56) References Cited

U.S. PATENT DOCUMENTS

| | | | | | |
|---|---|---|---|---|---|
| 4,817,943 | A * | 4/1989 | Pipasik | 482/97 |
| D306,053 | S | 2/1990 | Beistegui | |
| 5,171,198 | A * | 12/1992 | Jones | 482/97 |
| 5,190,509 | A | 3/1993 | Davison, Jr. | |
| 5,328,428 | A | 7/1994 | Huang | |
| 5,409,438 | A * | 4/1995 | Jones et al. | 482/100 |
| 6,450,923 | B1 | 9/2002 | Vatti | |
| 6,824,498 | B2 * | 11/2004 | Hassler | 482/1 |
| 7,503,882 | B2 * | 3/2009 | Sechrest et al. | 482/103 |
| 7,534,200 | B1 | 5/2009 | Martinez | |
| 7,601,105 | B1 * | 10/2009 | Gipson et al. | 482/103 |
| 7,722,509 | B2 * | 5/2010 | Eder | 482/99 |
| 7,909,742 | B2 * | 3/2011 | Ish et al. | 482/97 |
| 8,096,926 | B1 * | 1/2012 | Batca | 482/99 |
| 8,500,607 | B2 * | 8/2013 | Vittone et al. | 482/93 |
| 2003/0017918 | A1 * | 1/2003 | Webb et al. | 482/94 |
| 2003/0045406 | A1 * | 3/2003 | Stone | 482/100 |
| 2004/0033869 | A1 * | 2/2004 | Carlson | 482/121 |
| 2006/0116253 | A1 | 6/2006 | Nizam | |
| 2007/0161471 | A1 * | 7/2007 | Carter | 482/100 |
| 2008/0051256 | A1 * | 2/2008 | Ashby et al. | 482/5 |
| 2008/0176722 | A1 * | 7/2008 | Steffee | 482/98 |
| 2010/0190617 | A1 * | 7/2010 | Gautier | 482/94 |
| 2012/0225760 | A1 * | 9/2012 | Webb | 482/139 |
| 2013/0109542 | A1 * | 5/2013 | Hockridge et al. | 482/94 |

* cited by examiner

*Primary Examiner* — Oren Ginsberg
*Assistant Examiner* — Gary D Urbiel Goldner

(57) ABSTRACT

An upper body strengthening system features a generally U-shaped planar base having a vertical frame perpendicularly located in a base middle section. A seat is perpendicularly and adjustably located on a vertical frame middle along with a cushioned back rest. The system features a first arm having a first arm first end pivotally located on a vertical frame first side and a second arm having a second arm first end pivotally located on a vertical frame second side. A first palm plate is located offset from a first arm inside surface and a second palm plate is located offset from the second arm inside surface. A plurality of weight components is located close to a vertical frame bottom. The plurality of weight components is stackably located on a cable assembly (pulley system) that traverses a weight component rack and is connected to the first arm, and the second arm.

1 Claim, 8 Drawing Sheets

UPPER BODY STRENGTHENING SYSTEM

FIELD OF THE INVENTION to of The present invention relates to stationary exercise equipment for humans employing cables and a series of weighted components.

BACKGROUND OF THE INVENTION

A weight machine is a piece of equipment used for weight training using gravity as a primary source of resistance. It uses a combination of cables, pulleys, levers, wheels, and inclined planes to convey that resistance to the person using the machine. The present invention features an upper body strengthening system for decompressing the upper body muscles in a single motion for straightening the spine, strengthening the core and building posture, Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an upper body strengthening system for decompressing the upper body muscles in a single motion for straightening the spine, strengthening the core and building posture. In some embodiments, the system comprises a generally U-shaped planar base having a vertical frame perpendicularly located in a base middle section. In some embodiments, a seat is perpendicularly and adjustably located on a vertical frame middle along with a cushioned back rest. In some embodiments, the system comprises a first arm having a first arm first end pivotally located on a vertical frame first side and a second arm having a second arm first end pivotally located on a vertical frame second side. In some embodiments, a first palm plate is located adjacent to a first arm inside surface and a second palm plate is located adjacent to the second arm inside surface. In some embodiments, a plurality of weight components is located on a weight component rack. In some embodiments, the plurality of weight components is stackably connected to a cable assembly that traverses the weight component rack and is further connected to the first arm, and the second arm.

In some embodiments, in a first position, an outermost tip of the first palm plate spherical component faces an outermost tip of the second palm plate spherical component and the first arm inside surface is vertical and parallel with the second arm inside surface. In some embodiments, in a second position, the first arm inside surface is angularly located away from the second arm inside surface. In some embodiments, an upper body strengthening system is adapted to decompress the upper body muscles in a single motion for straightening the spine, strengthening the core and building posture.

DESCRIPTION OF PREFERRED EMBODIMENTS

Figure 1:
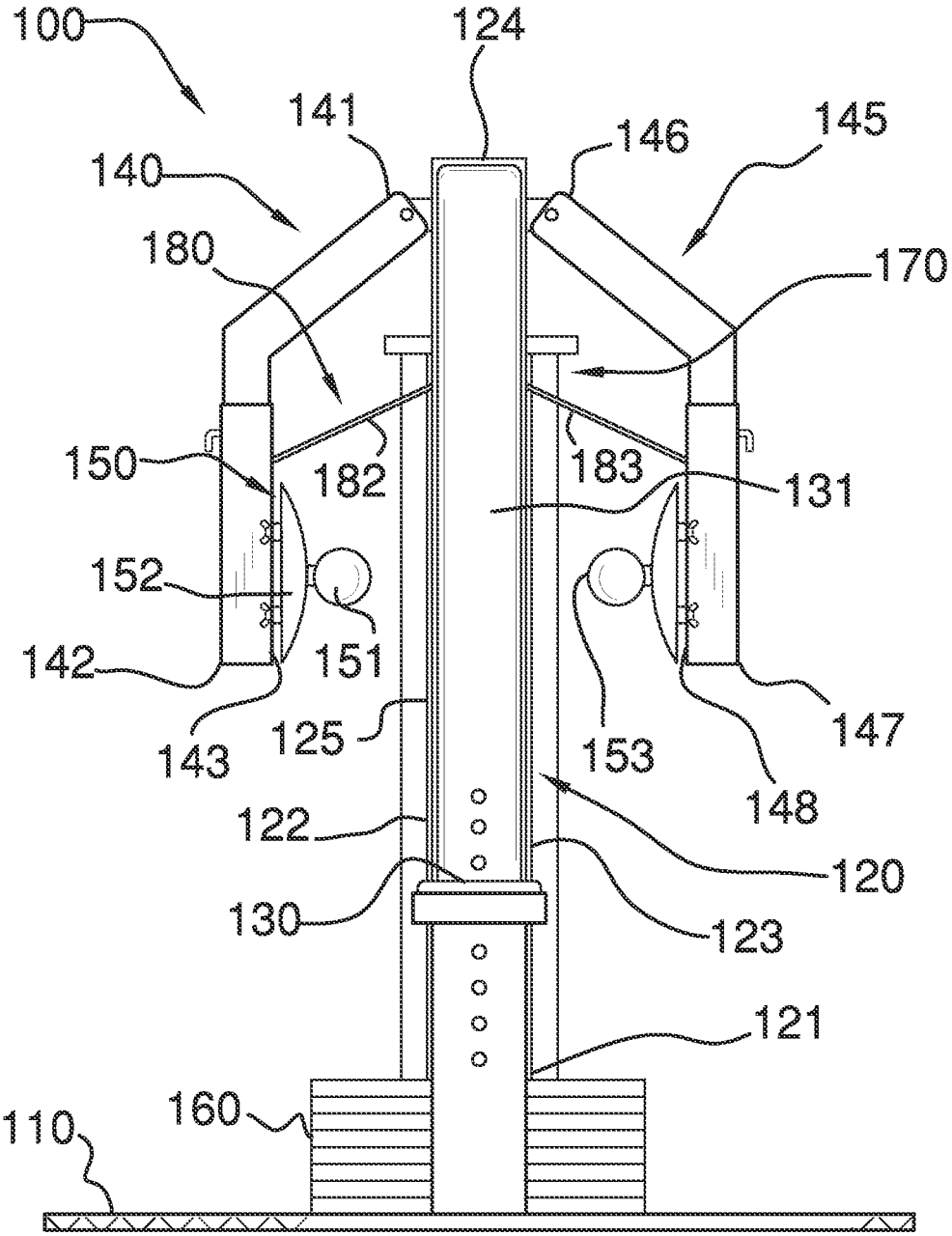
FIG. 1 shows a front view of the present invention.
Figure 2:
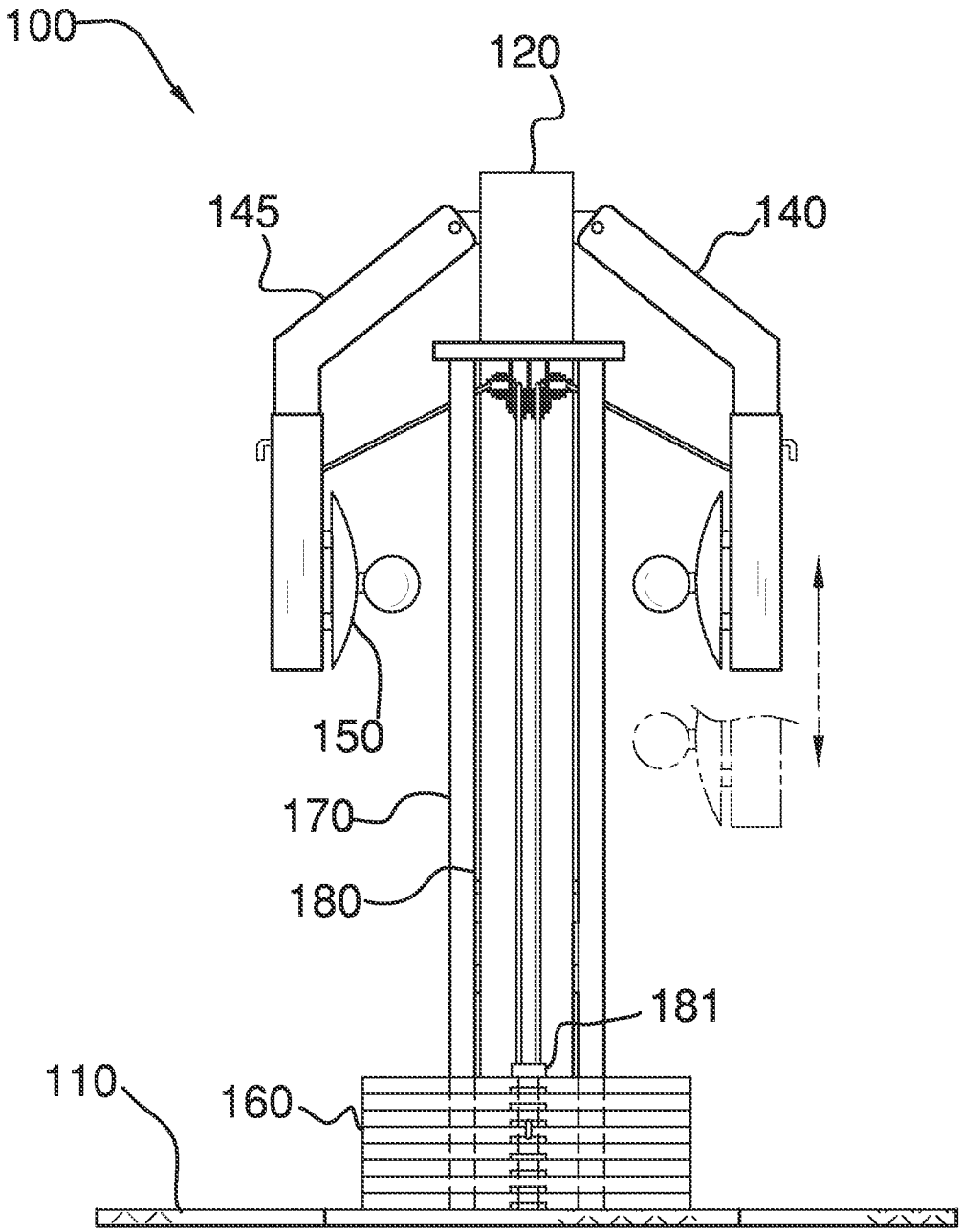
FIG. 2 shows a rear view of the present invention.
Figure 3:
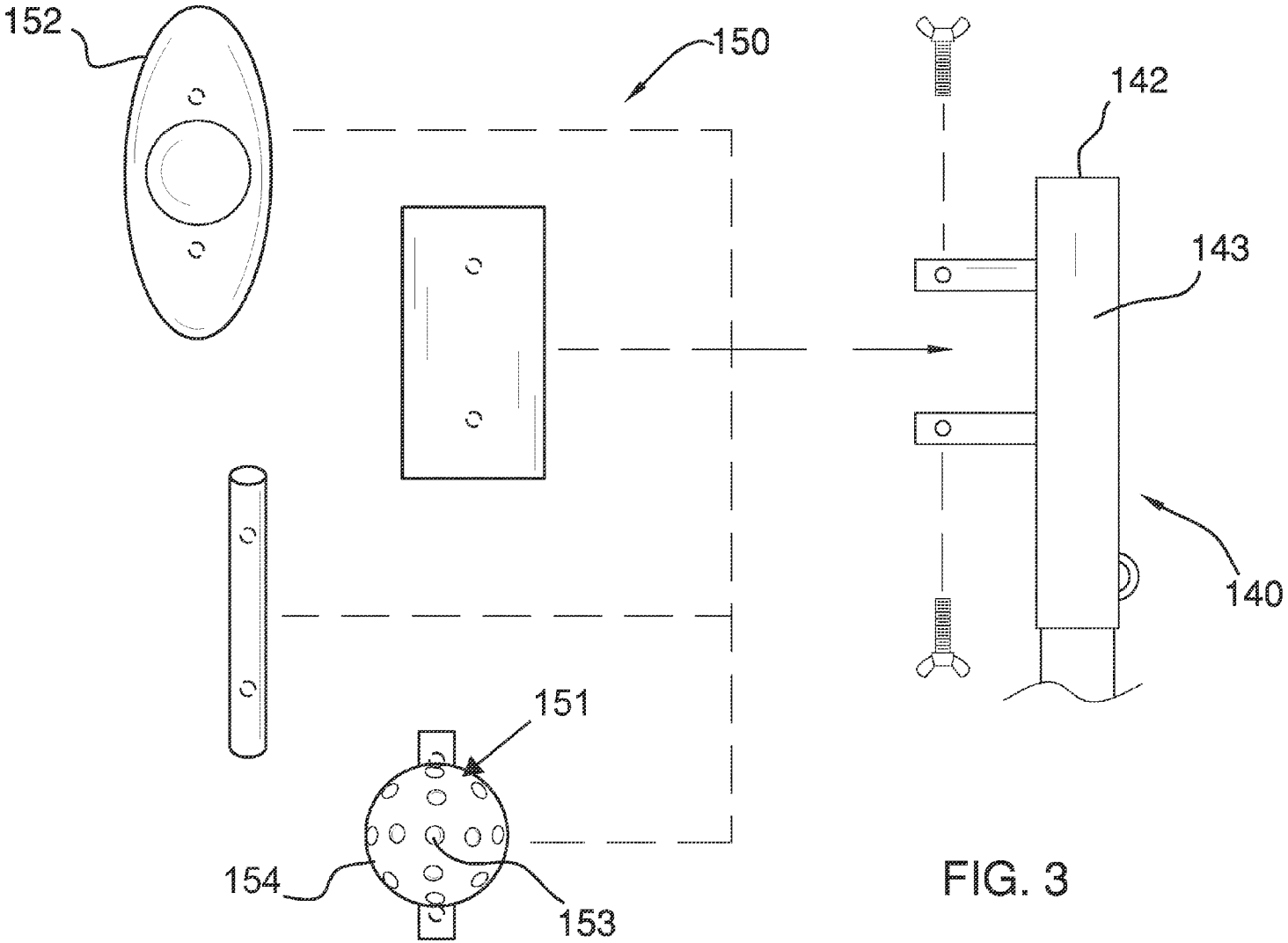
FIG. 3 shows a view of the detail of the palm plate of the present invention.
Figure 4:
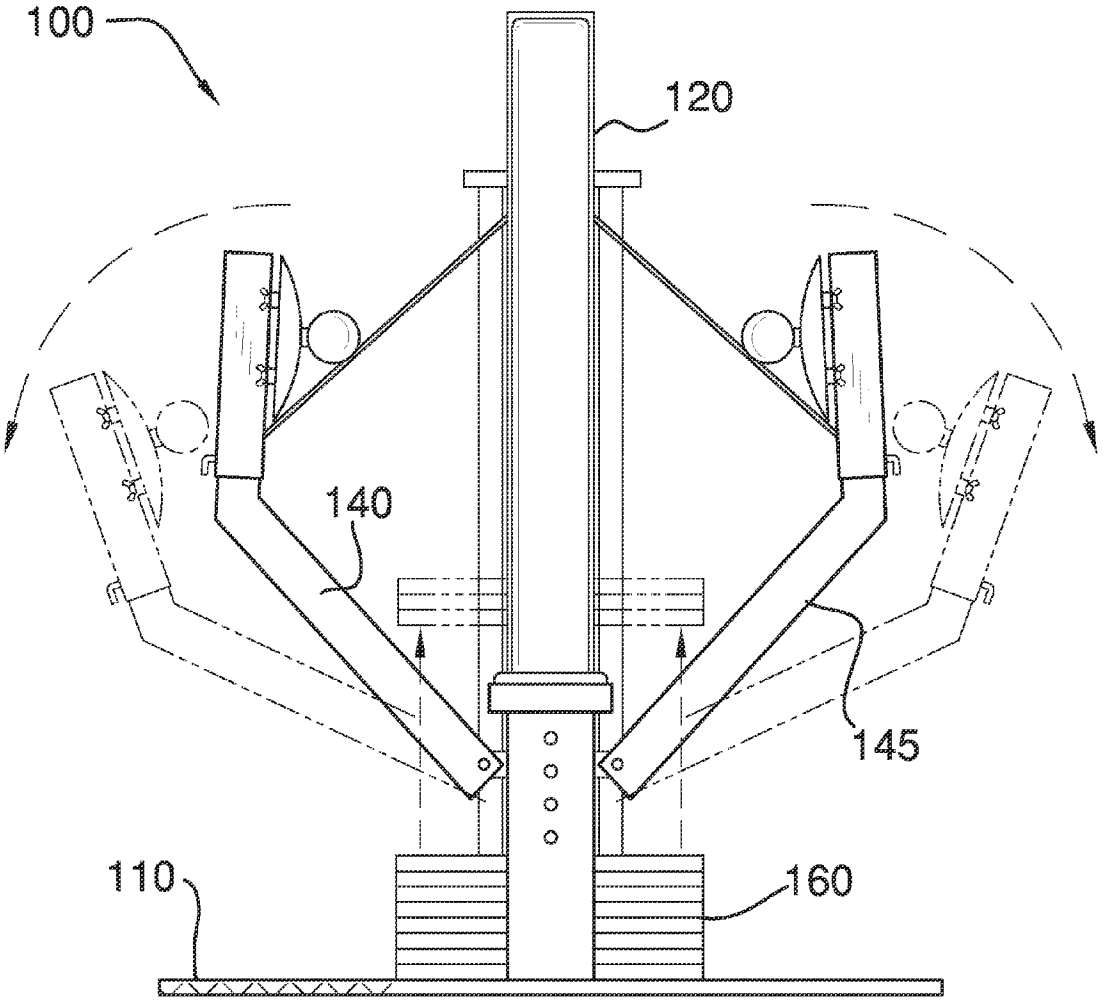
FIG. 4 shows a front view of an alternate embodiment of the present invention.
Figure 5:
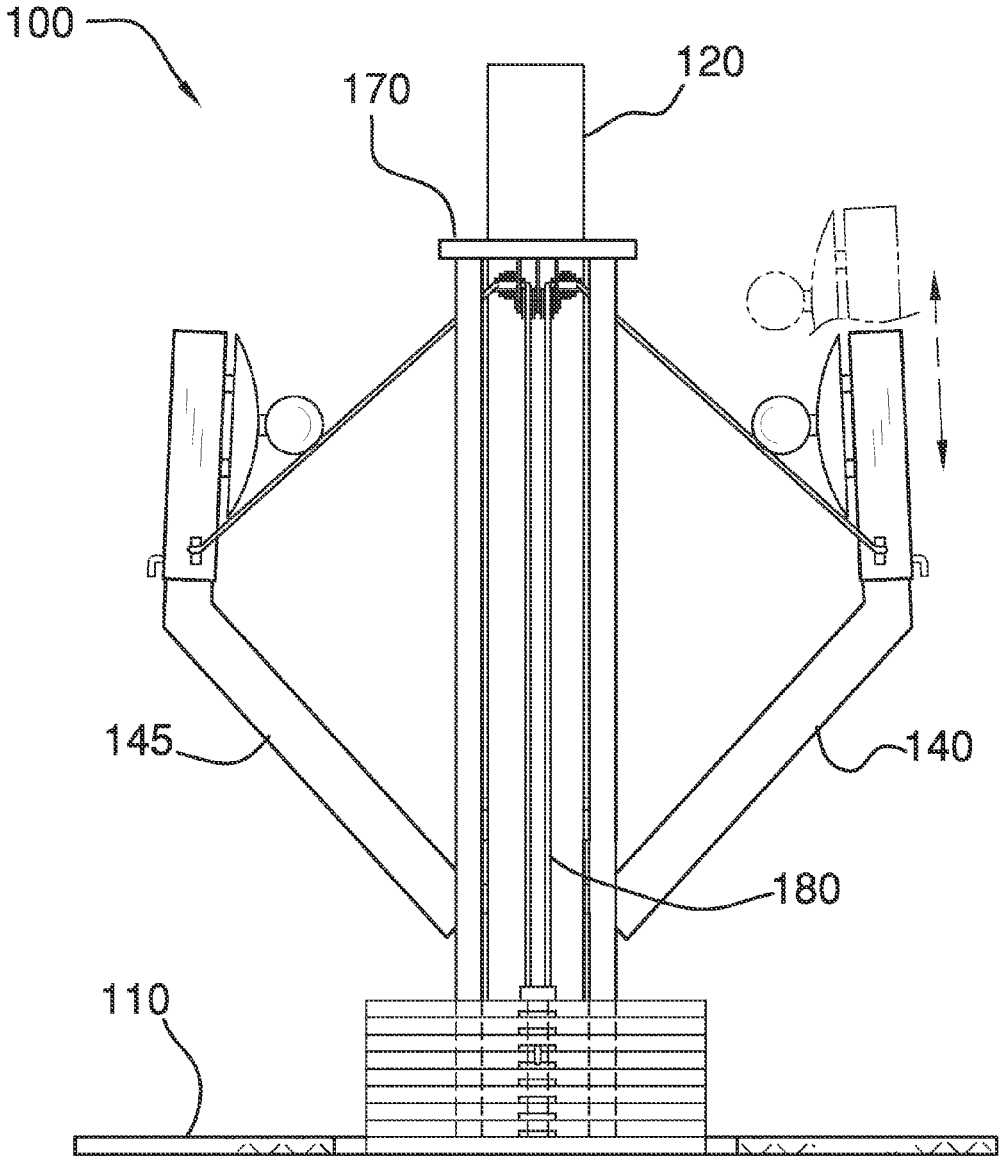
FIG. 5 shows a rear view of an alternate embodiment of the present Invention.
Figure 6:
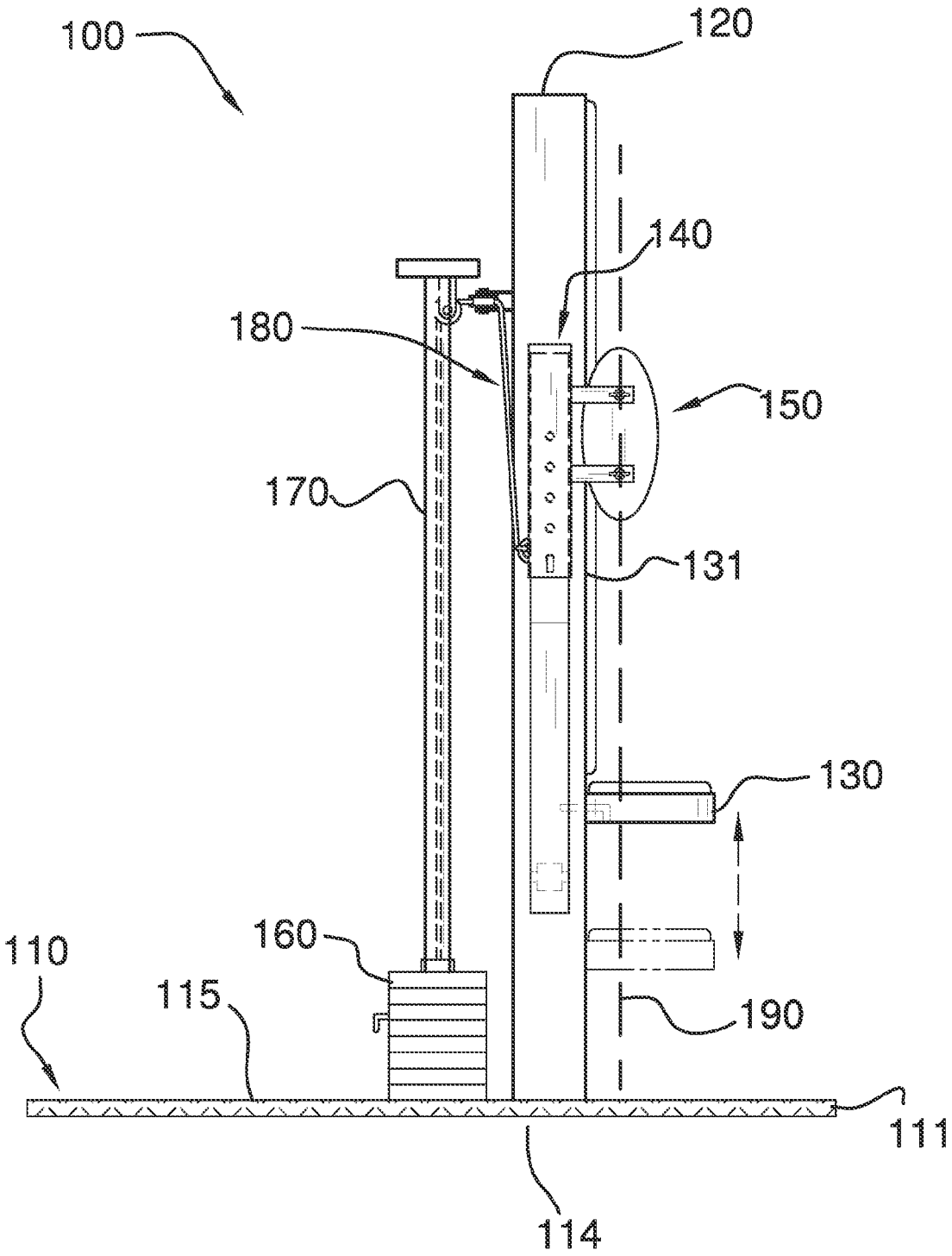
FIG. 6 shows a side view of an alternate embodiment of the present invention.

Following is a list of elements corresponding to a particular element referred to herein:

100 Upper body strengthening system
110 Planar base
111 Base front edge
112 First side base rear edge
113 Second side base rear edge
114 Base middle section
115 Base top surface
120 Vertical frame
121 Vertical frame bottom
122 Vertical frame first side
123 Vertical frame second side
124 Vertical frame top
125 Vertical frame middle
130 Seat
131 Cushioned back rest
140 Angled first arm
141 First arm first end
142 First arm terminating second end
143 First arm inside surface
145 Angled second arm
146 Second arm first end
147 Second arm terminating second end
148 Second arm inside surface
150 Palm plate
151 Spherical component
152 Palm plate base
153 Spherical component outermost tip
160 Weight component
170 Weight component rack
180 Cable assembly
181 Cable assembly first end
182 Cable assembly first side second end
183 Cable assembly second side second end
190 Coronal plane Referring now to FIG. 1-8, the present invention features an upper body strengthening system (100) for decompressing the upper body muscles in a single motion for straightening the spine, strengthening the core and building posture. In some embodiments, the system (100) comprises a generally U-shaped planar base (110) having a base front edge (111), a first side base rear edge (112), a second side base rear edge (113), a base middle section (114) located between the base front edge (111) and the base rear edges (112, 113), and a base top surface (115).

In some embodiments, the system (100) comprises a vertical frame (120) having a vertical frame bottom (121) perpendicularly located with respect to the base top surface (115) in a base middle section (114). In some embodiments, the vertical frame (120) comprises a vertical frame first side (122), a vertical frame second side (123), and a vertical frame top (124), In some embodiments, a seat (130) is perpendicularly and adjustably located on a vertical frame middle (125) between the vertical frame top (124) and the vertical frame bottom (121). In some embodiments, a cushioned back rest (131) is linearly located on the vertical frame middle (125). in some embodiments, the vertical frame (120) comprises a support.

In some embodiments, the system (100) comprises an angled first arm (140) having a first arm first end (141) pivotally located on a vertical frame first side (122). In some embodiments, the first arm (140) comprises an adjustable length. In some embodiments, the angled first are (140) comprises an angle of 10 degrees. In some embodiments, the angled first arm (140) comprises an angle of 20 degrees. In some embodiments, the angled first arm (140) comprises an angle of 30 degrees. In some embodiments, the angled first arm (140) comprises an angle of 40 degrees. In some embodiments, the angled first arm (140) comprises an angle of 50 degrees, In some embodiments, the angled first arm (140) comprises an angle of 60 degrees. In some embodiments, the angled first arm (140) comprises an angle of 70 degrees. in some embodiments, the angled first arm (140) comprises an angle of 80 degrees. In some embodiments, the angled first arm (140) comprises an angle of 90 degrees.

In some embodiments, the system (100) comprises an angled second arm (145) having a second arm first end (146) pivotally located on a vertical frame second side (123). In some embodiments, the second arm (145) comprises an adjustable length. In some embodiments, the angled second arm (145) comprises an angle of 10 degrees. In some embodiments, the angled second arm (145) comprises an angle of 20 degrees. In some embodiments, the angled second arm (145) comprises an angle of 30 degrees. In some embodiments, the angled second arm (145) comprises an angle of 40 degrees. In some embodiments, the angled second arm (145) comprises an angle of 50 degrees. In some embodiments, the angled second arm (145) comprises an angle of 60 degrees. In some embodiments, the angled second arm (145) comprises an angle of 70 degrees. In some embodiments, the angled second arm (145) comprises an angle of 80 degrees. In some embodiments, the angled second arm (145) comprises an angle of 90 degrees.

In some embodiments, the first arm (140) and the second arm (145) pivot in a coronal plane (190) with respect to the base front edge (111). In some embodiments, the coronal plane (190) is perpendicular to the base top surface (115). In some embodiments, the coronal plane (190) is parallel with the base front edge (111), the first side base rear edge (112), and the second side base rear edge (113).

In some embodiments, the system (100) comprises a palm plate (150) having a spherical component (151) tangentially located on a palm plate base (152) having a shape of an elliptical hemisphere. In some embodiments, a first palm plate (150) is located offset from a first arm inside surface (143) close to a first arm terminating second end (142) and a second palm plate (150) is located offset from the second arm inside surface (148) close to a second arm terminating second end (147), In some embodiments, a first palm plate (150) is located on a first arm inside surface (143) close to a first arm terminating second end (142) and a second palm plate (150) is located on the second arm inside surface (148) close to a second arm terminating second end (147). In some embodiments, the spherical component (151) is removable and replaceable by cylinder bars or flat palm plates both for pushing outward motion. In some embodiments, the spherical component (151) comprises divots. In some embodiments, the spherical component (151) comprises a covering located thereon. In some embodiments, the spherical component (151) comprises a rubber covering (154) located thereon. In some embodiments, the spherical component (151) is squeezeable. In some embodiments, the spherical component (151) is compressible. In some embodiments, the spherical component (151) is rigid. In some embodiments, hardware is used to affix the palm plate to the first arm (140) and the second arm (145). In some embodiments, the hardware includes one or more of the following: bolts, screws, washers, nuts, brackets, and plates.

In some embodiments, the system (100) comprises a plurality of weight components (160) located on a weight component rack (170). In some embodiments, the weight component rack (170) is located close to and parallel with the vertical frame (120). In some embodiments, the plurality of weight components (160) is stackably (and adjustably) located on a cable assembly first end (181). In some embodiments, a cable assembly (180) traverses the weight component rack (170). In some embodiments, the cable assembly first side second end (182) is located on the first arm (140). In some embodiments, the cable assembly second side second end (183) is located on the second arm (145).

In some embodiments, in a first position, a spherical component outermost tip (153) of the first palm plate faces a spherical component outermost tip (153) of the second palm plate and the first arm inside surface (143) is vertical and parallel with the second arm inside surface (148). In some embodiments, in a second position, a user disposes the first arm inside surface (143) away from the second arm inside surface (148), In some embodiments, the plurality of weight components (160) is vertically displaced.

In some embodiments, an upper body strengthening system (100) is adapted to decompress the upper body muscles in a single motion for straightening the spine, strengthening the core and building posture.

In some embodiments, the first arm first end (141) and the second arm first and (146) are pivotally located close to the vertical frame top (124). For example, FIGS. 1-2.

Figure 7:
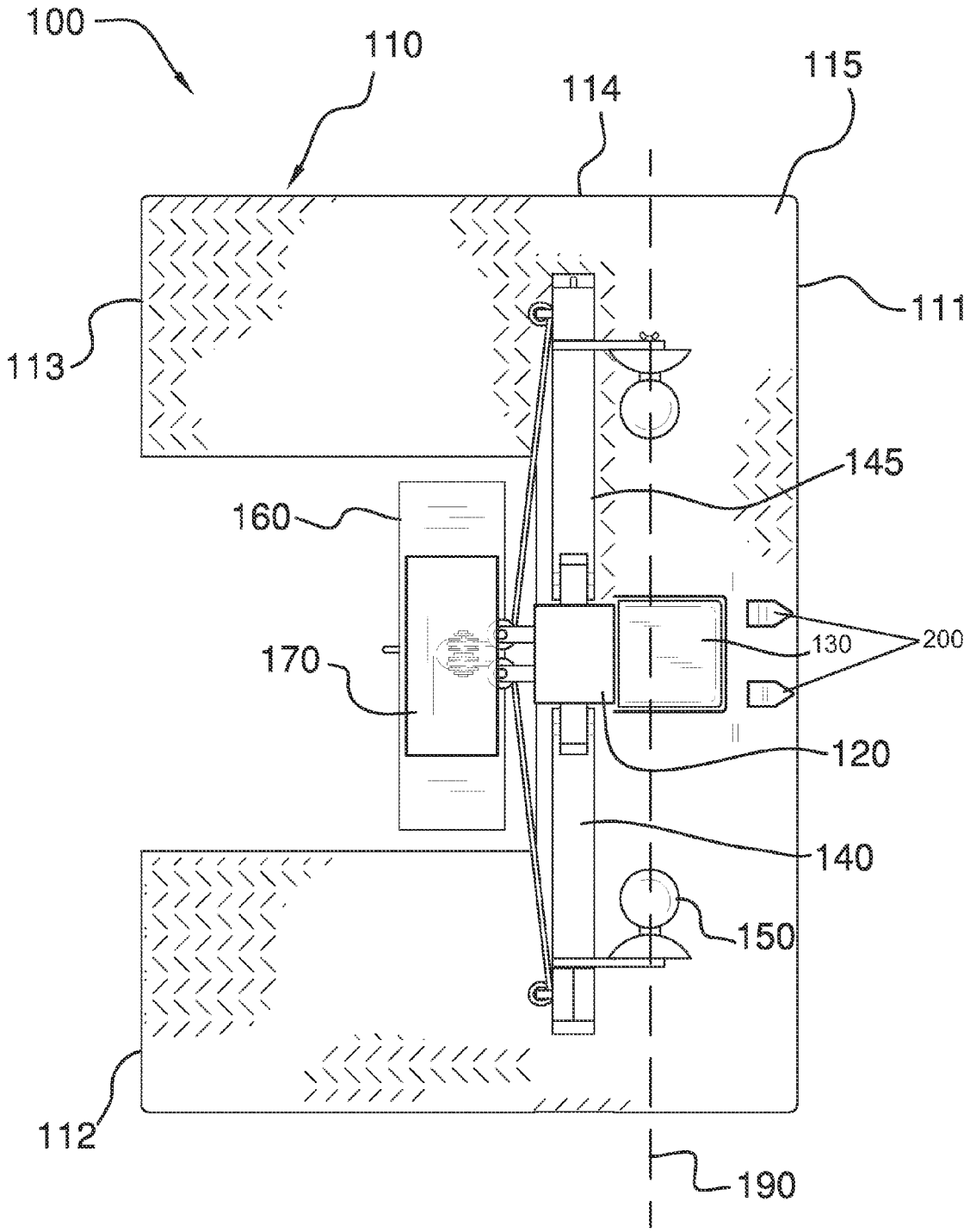
FIG. 7 shows a top view of an alternate embodiment of the present invention.
Figure 8:
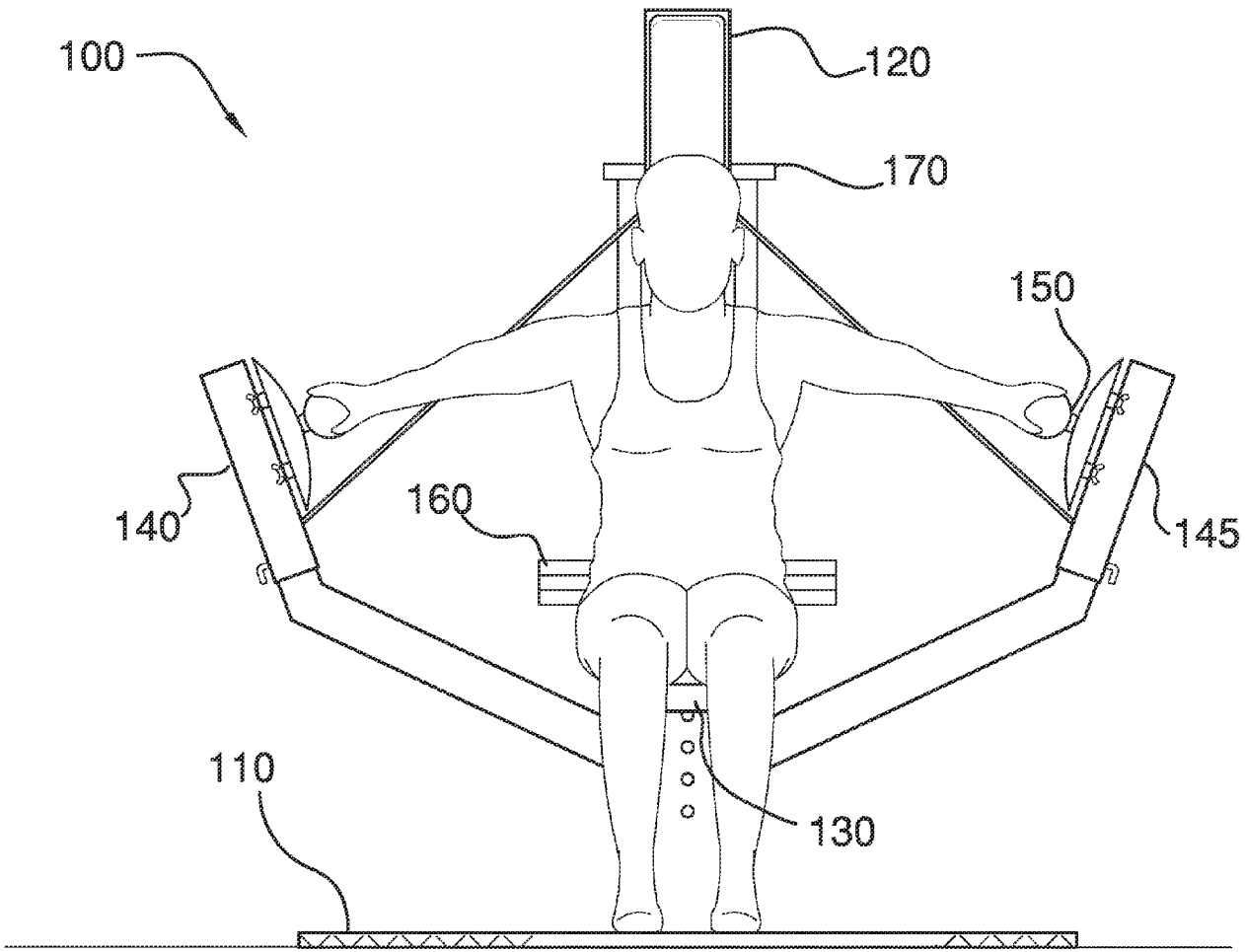
FIG. 8 shows a front view of alternate embodiment of the present invention in use.

In some embodiments, the first arm first end (141) and the second arm first end (146) are pivotally located close to the vertical frame bottom (121). For example, FIGS. 4-8. In some embodiments, the system (100) is configurable where the first arm first end (141) and the second arm first end (146) can be alternately moved between a position close to the vertical frame top (124), then moved to a position close to the vertical frame bottom (121) as a variant for exercising. In some embodiments, a pair of foot rest (200) is disposed on a base top surface (115) as shown in FIG. 7.

As used herein, the term "about" refers to plus or minus 10% of the referenced number.

The disclosures of the following U.S. Patents are incorporated in their entirety by reference herein: U.S. Pat. No. 5,190,509; U.S. Pat. No. 5,325,428; U.S. Pat. No. 6,450,923B1; U.S. Pat. No. 7,534,200; and U.S. Pat. No. D 306,053.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. An upper body strengthening system (100) for decompressing the upper body muscles in a single motion for straightening the spine, strengthening the core and building posture, wherein the system (100) consists of:

(a) a generally U-shaped planar base (110) consisting of a base top surface (115), a base front edge (111), a first side base rear edge (112), a second side base rear edge (113), and a base middle section (114) disposed between the base front edge (111) and the base rear edges;

(b) a vertical frame (120) consisting of a vertical frame bottom (121) perpendicularly disposed with respect to the base top surface (115) in the base middle section (114), a vertical frame first side (122), a vertical frame second side (123), and a vertical frame top (124), wherein a seat (130) is perpendicularly and adjustably disposed on a vertical frame middle (125) between the vertical frame top (124) and the vertical frame bottom (121), wherein a cushioned back rest (131) is linearly disposed on the vertical frame middle (125);

(c) an angled first arm (140) consisting of a first arm first end (141) pivotally disposed on the vertical frame first side (122), wherein the first arm (140) comprises an adjustable length;

(d) an angled second arm (145) consisting of a second arm first end (146) pivotally disposed on the vertical frame second side (123), wherein the second arm (145) comprises an adjustable length;

wherein the first arm (140) and the second arm (145) pivot in a coronal plane (190) with respect to the base front edge (111);

(e) a palm plate (150) consisting of a spherical component (151) tangentially disposed on a palm plate base (152) consisting of a shape of an elliptical hemisphere, wherein a first palm plate (150) is disposed offset from a first arm inside surface (143) proximal to a first arm terminating second end (142) via hardware and a second palm plate (150) is disposed offset from a second arm inside surface (148) proximal to a second arm terminating second end (147) via hardware, wherein the first palm plate (150) is fixedly attached to the first arm (140) and the second palm plate (150) is fixedly attached to the second arm (145); and (f) a plurality of weight components (160) disposed on a weight component rack (170), wherein the weight component rack (170) is disposed proximal to and parallel with the vertical frame (120), wherein the plurality of weight components (160) is stackably (and adjustably) disposed on a cable assembly first end (181), wherein a cable assembly (180) traverses the weight component rack (170), wherein a cable assembly first side second end (182) is disposed on the first arm (140), wherein a cable assembly second side second end (183) is disposed on the second arm (145);

wherein in a first position, a spherical component outermost tip (153) of the first palm plate (150) faces a spherical component outermost tip (153) of the second palm plate (150) and the first arm inside surface (143) is vertical and parallel with the second arm inside surface (148), wherein in a second position, a user disposes the first arm inside surface (143) away from the second arm inside surface (148), wherein the plurality of weight components (160) is coupled to the first arm (140) and the second arm (145) via the cable assembly (180) such that the plurality of weight components (160) is displaced when the first arm (140) and the second arm (145) are moved from the first position to the second position, wherein the plurality of weight components (160) is vertically displaced, wherein the upper body strengthening system (100) is adapted to decompress the upper body muscles in a single motion for straightening the spine, strengthening the core and building posture.

* * * * *